United States Patent [19]

Ikeda et al.

[11] 4,326,832

[45] Apr. 27, 1982

[54] EXHAUST OUTER CASING

[75] Inventors: Takashi Ikeda, Tokyo; Shinya Ayano, Fujisawa, both of Japan

[73] Assignee: Tokyo Shibaura Denki Kabushiki Kaisha, Kawasaki, Japan

[21] Appl. No.: 84,446

[22] Filed: Oct. 12, 1979

[30] Foreign Application Priority Data

Nov. 14, 1978 [JP] Japan ..... 53/140037

[51] Int. Cl.[3] ..... F01D 25/26

[52] U.S. Cl. ..... 415/219 R; 415/103

[58] Field of Search ..... 415/99, 101, 103, 108, 415/219 R; 60/694, 697

[56] References Cited

U.S. PATENT DOCUMENTS

| | | | |
|---|---|---|---|
| 1,723,104 | 8/1929 | Warren et al. | 60/697 X |
| 3,149,470 | 9/1964 | Herzog | 60/697 |
| 3,773,431 | 11/1973 | Bellati et al. | 415/101 |

*Primary Examiner*—Leonard E. Smith

*Attorney, Agent, or Firm*—Oblon, Fisher, Spivak, McClelland & Maier

[57] ABSTRACT

In a low pressure steam turbine which is constructed by an inner casing for supporting a rotatable turbine blade and an outer casing for supporting the inner casing, the outer casing is provided with a guide plate for causing the steam to flow laterally outward from the sides of the outer casing.

2 Claims, 5 Drawing Figures

EXHAUST OUTER CASING

BACKGROUND OF THE INVENTION

1. Field of the Invention:

This invention relates to a steam turbine casing, and more particularly to an improved exhaust outer casing adapted to be connected to a condenser.

2. Description of the Prior Art:

The exhaust pressure of a steam turbine having a condenser (so-called condensing turbine) will be at an extremely low pressure state, or nearly at vacuum. In the discharge of exhaust steam from such a condensing turbine to a condenser, it is desirable to provide as smooth a flow of steam as possible and to minimize energy losses which will occur on passing of the steam in the casing.

Heretofore, the condenser has been mounted under the exhaust casing, and the steam flowing at high speed from the exhaust portion of an inner casing having a rotatable turbine blade therein is introduced to the condenser from the inside of the exhaust casing.

However, since the exhaust casing has to support the inner casing and to permit passage therethrough to the condenser of as smooth a flow of steam as possible, it is necessary to satisfy such requirements. Moreover, in such prior art condensing turbines, the overall height of the apparatus resulting from the condenser being mounted under the exhaust casing becomes a problem.

SUMMARY OF THE INVENTION

Accordingly, it is an object of this invention to provide a new and improved unique steam turbine casing which can minimize energy losses which will occur on passing of the steam in the casing and which is relatively compact.

Briefly, in accordance with one aspect of this invention, an exhaust outer casing is provided for a steam turbine, wherein a low pressure steam turbine is constructed by an inner casing for supporting a rotatable turbine blade and an outer casing for supporting the inner casing, and the outer casing is adapted to be connected to a condenser. The exhaust outer casing comprises a base, a lower casing mounted on the base for supporting the inner casing and having means for receiving steam flow from the upper portion of the inner casing separately from the steam flow from the lower portion of the inner casing and outlet means for discharging the steam flows laterally outward from the sides of the lower casing, and an upper casing mounted on the lower casing and having means for introducing the flow to the inner casing to rotate the turbine.

BRIEF DESCRIPTION OF THE DRAWINGS

A more complete appreciation of this invention will be readily obtained as the same becomes better understood by reference to the following detailed description when considered in connection with the accompanying drawings, wherein.

DETAILED DESCRIPTION OF A PREFERRED EMBODIMENT

Figure 1:
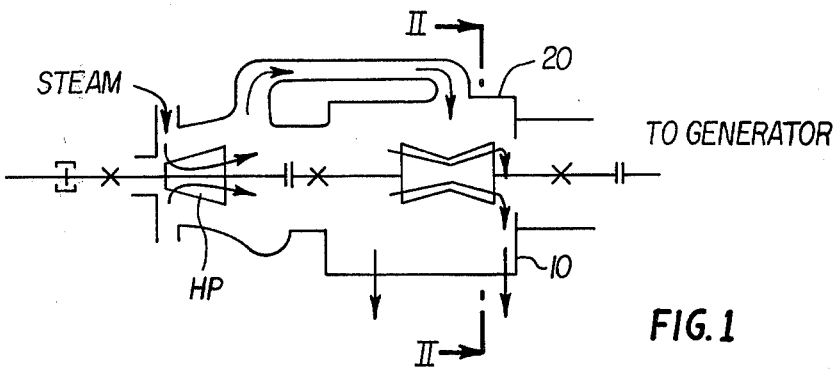
FIG. 1 is a schematic view of a conventional steam turbine.

Referring now to the drawings, wherein like reference numerals designate identical or corresponding parts throughout the several views, and more particularly to FIG. 1 thereof, a conventional steam turbine is shown as including a high pressure turbine HP and a low pressure turbine LP connected by a coaxial shaft of the high pressure turbine HP. The flow of steam from the high pressure turbine to the low pressure turbine is shown in FIG. 1 by the arrows. The shaft of the turbine is also connected to a generator (not shown).

Figure 2:
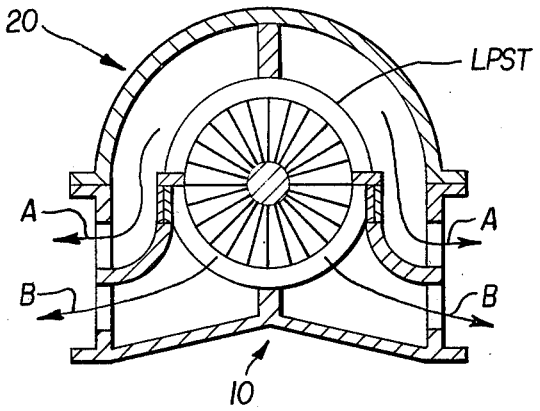
FIG. 2 shows a section of the casing taken along the line II—II of FIG. 1, but being constructed according to the present invention.
Figure 5:
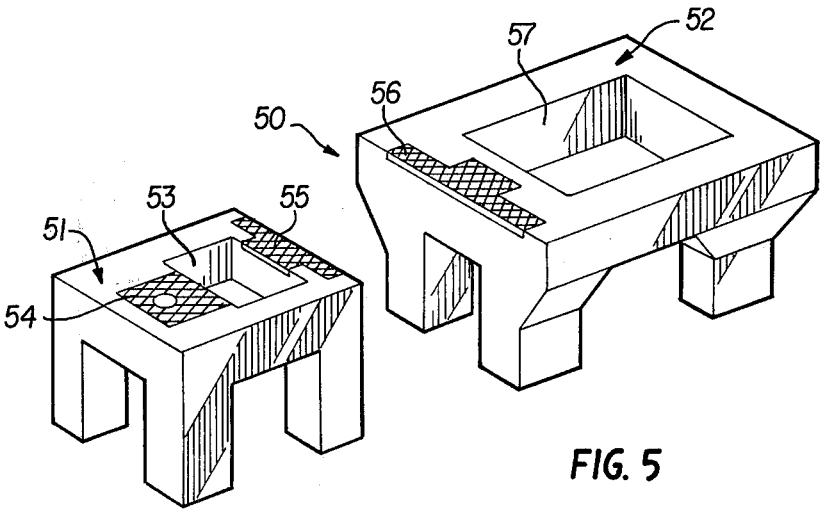
FIG. 5 shows a stand member for supporting the steam turbine.

As shown in FIG. 2, the steam from the low pressure steam turbine LPST flows laterally outward from the sides of a lower casing 10 to corresponding condensers (not shown) disposed on the sides of the lower casing.

An exhaust outer casing for the steam turbine comprises the lower casing 10 for supporting the low pressure steam turbine LP and an upper casing 20 mounted on the lower casing.

Figure 3:
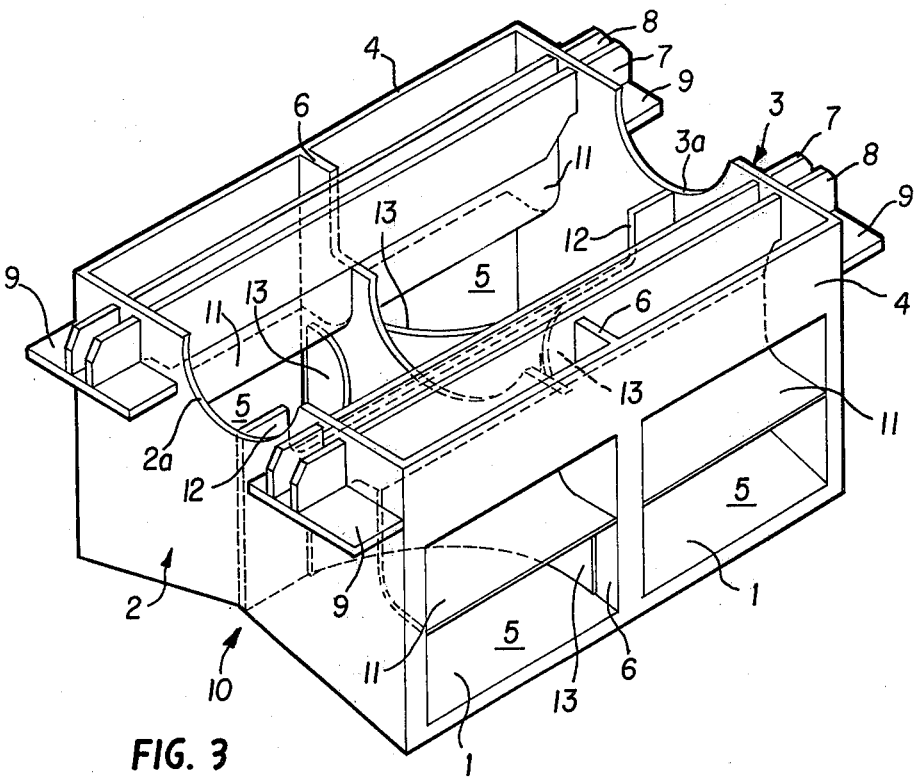
FIG. 3 illustrates a diagrammatic view of the lower casing according to this invention.

In FIG. 3, the lower casing 10 is constructed with a pair of front and back walls 2, 3 having half-circular openings 2*a*, 3*a* corresponding to the portion of the turbine rotor shaft to be received therein, a pair of side walls 4, 4 each having exhaust openings 5 for laterally discharging the steam from the low pressure steam turbine against the shaft, and a bottom 1.

The exhaust openings 5 are divided by a partition board 6 because the low pressure steam turbine is constructed to be of the double flow type. Two pairs of parallel ribs 7, 8, which support the inner casing and are formed to pass the flow of steam from the nozzle diaphragm and turbine blade, are mounted over the front and back walls 2, 3, being symmetrically disposed along the rotor shaft.

These ribs 7, 8 project out from the front and back walls 2, 3 and are attached to footplates 9 which are in turn attached to the front and back walls to be supported by stand members, as will be explained hereinafter. Since these ribs are spaced without contacting the partition board 6, they are not affected by the deformation of the exhaust casing which will occur in accordance with an increase in the degree of vacuum in the casing.

One end portion of the ribs 7 or 8 is connected with a corresponding end portion of a guide plate 11, which extends to the exhaust opening 5, so as to divide each of the openings 5 substantially in half.

The bottom 1 of the lower casing 10 is formed with a roof-shape so as to smooth the flow of steam as much as possible. Thus, the center of the bottom 1, along its axis, is higher than the lower side ends thereof. Curved guide plates 13 are provided between the partition board 6 and vertical members 12 which are mounted on the bottom 11.

These plates 13, shown being four in number, form an arcuate wall at each rear inside corner of the bottom 11 and function to make the axial component of the exhaust flow to smoothly change toward the radial direction.

Figure 4:
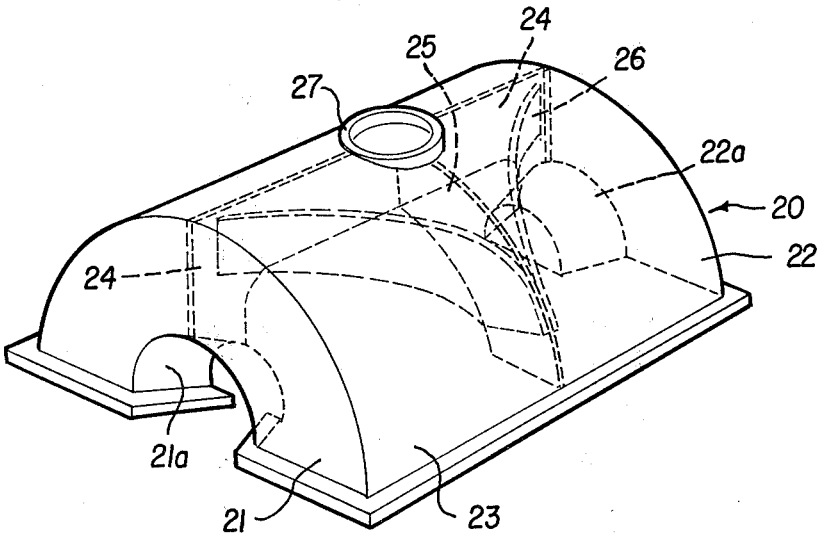
FIG. 4 illustrates a diagrammatic view of the upper casing according to this invention.

On the other hand, as shown in FIG. 4, there is provided an upper casing 20 which is adapted to be mounted on the lower casing 10 and is formed with a dome-like configuration. A curved ceiling plate 23, which provides the dome-like structure of the upper casing, is provided between the front and back walls 21 and 22 thereof. The front and back walls 21 and 22, respectively, have rotor receiving tapered openings 21*a*, 22*a* to receive the rotor shaft. A vertical axially extending member 24, which corresponds to the vertical member 12 of the lower casing 10, is provided on the inside of the middle of the ceiling plate 23 in order to reinforce the mechanical strength of the ceiling 23.

Moreover, a central partition board 25, which corresponds to the partition board 6, is provided on the inside of the ceiling plate 23. Curved guide plates 26, which correspond to the curved guide plates 13 of the lower casing 10 and have the same function, are symmetrically provided on the inside of the ceiling plate 23. In the middle portion of the ceiling plate 23, a steam inlet 27, which allows introduction of the steam from the high pressure steam turbine HP, is formed.

in FIG. 4, the curved guide plates 26 and the central partition board 25 are shown on only one side of the partition board 24, to more easily illustrate this invention.

Now follows an explanation of the flow of steam.

In FIGS. 2 and 3, the exhaust flow from the upper side of the inner casing (low pressure steam turbine) will pass through the passage or space formed between each pair of ribs 7, 8 and the inner wall of the ceiling plate 20 and then discharge from the upper halves of the openings 5, being guided by the guide plates 11 to the condenser (not shown). This flow is illustrated by the arrows A in FIG. 2.

Similarly, the exhaust flow from the lower side of the inner casing will pass through the passage or space formed between the ribs 7 and 8 and the central vertical member 12 and then discharge from the lower halves of the openings 5, being guided by the guide plates 11 and 13 to the condenser. This flow is illustrated by the arrows B in FIG. 2.

Thus, the exhaust flow is divided into upper and lower components in each of the quarter sections by the ribs 7 and 8 and the guide plates 11 so that the generation of any energy losses by the interference of two components of exhaust with each other is prevented, whereby the recovery of static pressure of steam flow which is in the motive condition is positively achieved.

This compound type turbine comprising a high pressure turbine and a low pressure turbine having an exhaust casing is mounted on a stand member generally designated by the reference numeral 50 and formed from a front member 51 and a back member 52. In the front stand member 51, a concave or opening 53 is provided to accommodate the high pressure casing of a high pressure turbine.

A metallic plate 54 for receiving a gear box (not shown) and a metallic plate 55 for receiving one footplate 9 of the lower casing 10 are provided on the upper surface of the front member 51.

The exhaust outer casing is mounted between the front and back stand members 51 and 52. The other footplate 9 of the lower casing is mounted on a metallic plate 56 of the back stand member 52. There is a concave or an opening 57 for receiving the generator (not shown) in the back member 52.

According to the teachings of this invention, it is possible to minimize the pressure losses because the generation of collision of steam flow will be prevented by using the guide plates. It is further possible to make a compact and not so tall unit because the condenser is provided at the sides of the exhaust casing Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An exhaust outer casing for a steam turbine wherein a low pressure steam turbine is constructed by an inner casing for supporting a rotatable turbine blade and an outer casing for supporting the inner casing, and said outer casing is adapted to connect to a condenser, the exhaust outer casing comprising:

a base;

a lower casing mounted on the base for supporting the inner casing and having means for receiving steam flow from the upper portion of the inner casing separately from the steam flow from the lower portion of the inner casing, and outlet means for discharging said steam flow laterally outward from the sides of the lower casing, and an upper casing mounted on the lower casing and having means for introducing the flow to the inner casing to rotate the turbine, wherein the bottom of the lower casing is inclined from its opposite sides to the middle thereof.

2. An exhaust outer casing according to claim 1, wherein said means for receiving steam flow from the upper portion of the inner casing separately from the steam flow from the lower portion of the inner casing comprises a guide plate.

* * * * *